US007780550B2

(12) United States Patent
Komatsu et al.

(10) Patent No.: US 7,780,550 B2
(45) Date of Patent: Aug. 24, 2010

(54) COLOR GOLF BALL

(75) Inventors: Atsushi Komatsu, Chichibu (JP); Atsuki Kasashima, Chichibu (JP); Takashi Ohira, Chichibu (JP); Kae Iiduka, Chichibu (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 228 days.

(21) Appl. No.: 12/167,423

(22) Filed: Jul. 3, 2008

(65) Prior Publication Data

US 2010/0004072 A1 Jan. 7, 2010

(51) Int. Cl.
*A63B 37/00* (2006.01)

(52) U.S. Cl. ..... 473/353; 473/351; 473/378

(58) Field of Classification Search ..... 473/353, 473/351, 378

See application file for complete search history.

(56) References Cited

U.S. PATENT DOCUMENTS

| | | | |
|---|---|---|---|
| 6,022,279 | A | 2/2000 | Yamagishi et al. |
| 6,435,984 | B1 | 8/2002 | Ohama |
| 6,561,923 | B1 | 5/2003 | Ohama et al. |
| 7,291,076 | B2 | 11/2007 | Watanabe |
| 2007/0015603 | A1 | 1/2007 | Watanabe |
| 2007/0135234 | A1 | 6/2007 | Nagasawa |

FOREIGN PATENT DOCUMENTS

| | | | |
|---|---|---|---|
| JP | 10-155937 | A | 6/1998 |
| JP | 2000-24139 | A | 1/2000 |
| JP | 2000-25425 | A | 9/2000 |
| JP | 2004-33594 | A | 2/2004 |
| JP | 3862332 | B2 | 10/2006 |
| JP | 2007-21204 | A | 2/2007 |
| JP | 2007-21205 | A | 2/2007 |
| JP | 2007-144097 | A | 6/2007 |

*Primary Examiner*—Raeann Trimiew
(74) *Attorney, Agent, or Firm*—Sughrue Mion, PLLC

(57) ABSTRACT

The invention provides a colored golf ball composed of a core, a cover having a plurality of dimples formed on an outside surface thereof, and an inside layer in contact with the cover. The ball satisfies the following conditions:

(i) a color difference $\Delta E^*$ between the inside layer and the ball of at least 30;
(ii) the inside layer has a lightness L* value, expressed in the L*a*b* color system based on JIS Z8729, of at least 82 and a chroma C, defined as $(a^{*2}+b^{*2})^{1/2}$, of at most 10;
(iii) the ball has a lightness L* value of at least 50;
(iv) the lightness L* value of the ball≦the lightness L* value of the inside layer;
(v) the inside layer has a transparency which is up to 10% in terms of total transmittance and up to 1.0% in terms of parallel transmittance; and
(vi) the cover has a transparency which is at least 50% in terms of total transmittance and at least 1.0% in terms of parallel transmittance.

The colored golf ball of the invention is a fluorescent ball, yet retains a sense of transparency and thus confers a sense of quality. The ball also has weather resistance and is able to prevent changes in color. Moreover, the golf ball of the invention has a reassuring and psychologically calming effect on the golfer during play, and has a suitable look and feel.

9 Claims, 4 Drawing Sheets

COLOR GOLF BALL

BACKGROUND OF THE INVENTION

The present invention relates to a colored golf ball having a fluorescent color. More specifically, the invention relates to a fluorescent colored golf ball which is endowed with a coloring that conveys a sense of quality, performance attributes, and an excellent color change resistance that are acceptable to the skilled golfer.

Of the qualities other than performance sought in a golf ball, emphasis has begun to be placed on the psychological effect produced by the appearance of the ball. Golf balls in colors such as yellow, pink and orange have hitherto been disclosed in the art. However, owing to the emphasis placed on the visibility of the ball, such balls have lacked a high-quality feel. Also, the skilled golfer strives constantly to play the sport in a calm state of mind. In addition, golfers tend to dislike losing balls during play.

At the same time, with the increased versatility of golf balls in recent years, adopting an at least three-piece construction composed of a core, an intermediate layer and a cover is becoming a precondition for the creation of golf balls capable of satisfying the skilled golfer. In solid multi-piece golf balls composed of three or more pieces, the sensory impression left by the ball varies depending on differences in the thickness and color of each layer.

Golf balls which, in addition to being endowed with good performance attributes, also convey a sense of quality and moreover have a reassuring and psychologically calming effect on the golfer have yet to appear on the market.

Golf balls which have hitherto been disclosed include the following prior art.

JP-A 2007-21204, which describes a golf ball having a clear cover over a core that is coated with a bright pigment-containing coating, strives to achieve a metallic texture and markings that appear three-dimensional. The intention is not to provide a fluorescent colored ball.

JP-A 2007-21205 describes a golf ball in which the color difference ΔE between an inside layer and the ball is set to a small value of 30 or less. However, this ball has a subdued appearance that lacks visual impact. Moreover, the object here is to include a pearlescent pigment in the cover so as to give the cover a pastel tone; it is not the object of this prior-art disclosure to use a fluorescent pigment or dye so as to achieve bright coloring having a high-quality feel.

U.S. published patent application Ser. No. 11/882216 discloses an invention relating to a two-piece golf ball. However, this ball does not have a construction of three or more pieces such as would satisfy the skilled golfer, and is inferior in terms of performance. Moreover, a large amount of fluorescent pigment is added to the cover, resulting in a less than adequate transparency and an excessively strong color tone which deprives the ball of a high-quality feel. Also, the addition of a large amount of fluorescent pigment gives the ball a poor resistance to color change.

The golf ball described in JP-A 2007-144097 lacks specificity concerning the intermediate layer transparency and the cover transparency, in addition to which no mention whatsoever is made of a high-quality feel.

JP-A 10-155937, JP No. 3862332, and JP-A 2000-254250 mention balls which exhibit pastel tones. However, these golf balls are very deeply colored and visually disconcerting. Moreover, they lack a high-quality feel and have a poor resistance to color change.

JP-A 2000-24139 discloses a colored ball of excellent visibility which has a bright, highly intense color tone. However, because the cover contains a large amount of fluorescent pigment, it is not sufficiently transparent and has an excessively strong color, resulting in a ball that lacks a high-quality feel.

JP-A 2004-33594 describes a golf ball of blue, pink or yellow color which is specified in terms of the L*a*b* color system so as to enhance visibility. However, such golf balls do not excel in terms of a high-quality feel, performance and resistance to color change.

U.S. Published Patent Application No. 11/299947 discloses the enhancement of ball visibility by specifying light-harvesting fluorescent dyes and dimple edge angles. However, because the inner layer is given a light white color or is of the same color as the cover, the ball lacks a certain brightness of coloring and ends up a darker shade.

SUMMARY OF THE INVENTION

It is therefore an object of the present invention to provide a colored golf ball which has good weather resistance and prevents color change, has a reassuring and psychologically calming effect on the golfer during play, and has a suitable look and feel.

The inventors have conducted extensive investigations aimed at achieving the above object. Consequently, as a way of satisfying the twin desires among skilled golfers for a good performance and a high-quality feel in a golf ball, the inventors have invented a golf ball which, although fluorescent, has a transparent feel and conveys a sense of quality. That is, the inventors have discovered that by making the intermediate layer of a material which has a low light transmittance in virtue of color and making the cover of a material having a high light transmittance, color can easily be imparted and the ball can be provided with weather resistance and prevented from changing color. Moreover, the resulting ball has a reassuring and psychologically calming effect on the golfer during play, and has a suitable look and feel. It is possible with such an arrangement to impart the ball with a suitable color without being affected by the color of the core.

That is, to impart a sense of quality to a fluorescent golf ball, the present invention confers the golf ball cover with transparency and makes the color of the underlying intermediate layer white. Moreover, because the coloration of the ball as a whole is manifested through the construction of the intermediate layer and the cover, the quantities in which the individual pigments or dyes are added can be held to relatively small amounts, thereby enabling a ball which also has an excellent resistance to color change to be provided.

Accordingly, the invention provides the following colored golf balls.

[1] A colored golf ball comprising a core, a cover having a plurality of dimples formed on an outside surface thereof, and an inside layer in contact with the cover, which ball satisfies the following conditions:

(i) a color difference ΔE* between the inside layer and the ball of at least 30;

(ii) the inside layer has a lightness L* value, expressed in the L*a*b* color system based on JIS Z8729, of at least 82 and a chroma C, defined as $(a^{*2}+b^{*2})^{1/2}$, of at most 10;

(iii) the ball has a lightness L* value of at least 50;

(iv) the lightness L* value of the ball≦the lightness L* value of the inside layer;

(v) the inside layer has a transparency which is up to 10% in terms of total transmittance and up to 1.0% in terms of parallel transmittance; and (vi) the cover has a transparency which is at least 50% in terms of total transmittance and at least 1.0% in terms of parallel transmittance.

[2] The colored golf ball of [1], wherein the surface of the ball is coated with a coating composed of 100 parts by weight of a base resin, from 0.05 to 0.5 part by weight of a fluorescent whitener and from 0.1 to 0.6 part by weight of a pearlescent pigment, which coating has a fluorescent whitener/pearlescent pigment weight ratio of from 0.08 to 5.0.

[3] The colored golf ball of [1], wherein the inside layer and the cover have a combined thickness of from 0.8 to 3.0 mm.

[4] The colored golf ball of [1], wherein the inside layer contains at least 1 part by weight of a white pigment per 100 parts by weight of base resin.

[5] The colored golf ball of [1], wherein the cover has a thickness of from 0.3 to 2.1 mm.

[6] The colored golf ball of [1], wherein the cover contains of from 0.001 to 0.4 part by weight of a pigment or dye per 100 parts by weight of base resin.

[7] The colored golf ball of [6], wherein the dye in the cover is a blue dye which is included in an amount of up to 0.1 part by weight per 100 parts by weight of base resin, and the cover has a surface color with an L* value of at least 50, an a value of from −20 to 20, and a b* value of −20 or below.

[8] The colored golf ball of [6], wherein the cover contains at least 1.0 part by weight of calcium carbonate as a diffuser for the dye per 100 parts by weight of base resin.

[9] The colored golf ball of [1], wherein the number of dimples is at most 330 and the sum of the individual dimple surface areas, defined for each dimple as the surface area of a flat plane enclosed by an edge of the dimple, is at least 80% of the spherical surface area of the ball were the ball to have no dimples thereon.

BRIEF DESCRIPTION OF THE DIAGRAMS

DETAILED DESCRIPTION OF THE INVENTION

The invention is described more fully below.

Figure 1:
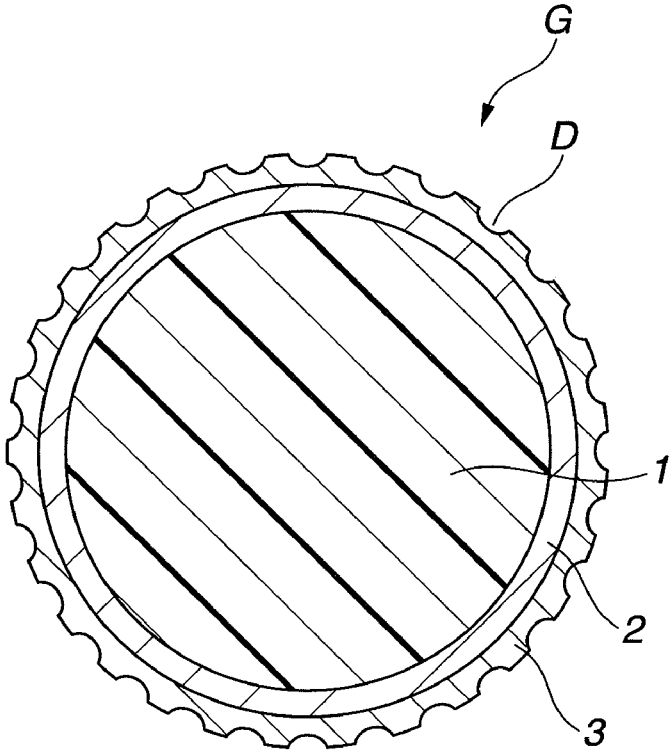
FIG. 1 is a schematic cross-sectional view of a golf ball illustrating an embodiment of the invention.

The golf ball of the present invention has a ball construction which includes a core, a cover having a plurality of dimples formed on an outside surface thereof, and an inside layer in contact with the cover. For example, as shown in the cross-sectional view of a golf ball in FIG. 1, the inventive ball may be a three-piece golf ball having an internal construction consisting of a core 1, a cover 3 on which a plurality of dimples D are formed, and an inside layer (intermediate layer) 2 interposed therebetween. FIG. 1 shows a solid, three-piece golf ball, although by having the inside layer (intermediate layer) 2 composed of two more layers, it is also possible for the ball to be a solid, multi-piece golf ball consisting of four or more pieces. "Inside layer," as used in the present invention, refers to a layer which is positioned to the inside of the cover serving as the outermost layer and is in direct contact with the cover. In a three-piece golf ball like that shown in FIG. 1, lo the inside layer, because it is disposed intermediate to the core and the cover, may be called the "intermediate layer." In the present invention, the desired effects of the invention can be achieved as a result of the color tone and transparency exhibited by the inside layer and the cover. Hence, in the present invention, the ball performance required by skilled golfers in particular can be satisfied by adopting a ball construction of three or more pieces, and the desired effects of the invention can be comprehensively achieved by satisfying the subsequently described conditions (i) to (iv).

The golf ball of the invention satisfies the following conditions:

(i) a color difference ΔE* between the inside layer and the ball of at least 30;

(ii) the inside layer has a lightness L* value, expressed in the L*a*b* color system based on JIS Z8729, of at least 82 and a chroma C, defined as $(a^{*2}+b^{*2})^{1/2}$, of at most 10;

(iii) the ball has a lightness L* value of at least 50;

(iv) the lightness L* value of the ball≦the lightness L* value of the inside layer;

(v) the inside layer has a transparency which is up to 10% in terms of total transmittance and up to 1.0% in terms of parallel transmittance; and (vi) the cover has a transparency which is at least 50% in terms of total transmittance and at least 1.0% in terms of parallel transmittance.

Condition (i)

A color difference ΔE* between the inside layer and the ball is at least 30. That is, the color difference between the inside layer and the ball is large and, as subsequently described, the cover has a degree of transparency, as a result of which a color tone that shows through and imparts a sense of quality can be exhibited. Here, by determining the L* value (lightness) and the a* and b* values (color coordinates) based on the L*a*b* color system in JIS Z8729, the following can be calculated:

$$\Delta E^*=\{(\Delta L^*)^2+(\Delta a^*)^2+(\Delta b^*)^2\}^{1/2}.$$

The color difference ΔE* represents the linear distance between two colors in this color space.

When the inside layer in this invention is measured based on the L*a*b* color system, the object measured is not the inside layer per se, but rather a sphere composed of both the core or other spherical body inside the inside layer together with the inside layer covering the spherical body. Such measurement gives the L*a*b* values for the inside layer. Hence, the color difference ΔE* is computed from the L*a*b* values for the inside layer.

Condition (ii)

It is essential that, as expressed by the L*a*b* method, the inside layer have a lightness L* value of at least 82 and a chroma C, defined as $(a^{*2}+b^{*2})^{1/2}$, of at most 10. The L* value is preferably at least 84, and more preferably at least 86, but preferably not more than 98, and more preferably not more than 97. When the intermediate layer is closer to white, the L* value of the ball is larger, resulting in a luminous color. Regardless of the color of the core, imparting a color to the intermediate layer does not result in a loss in ball coloration.

Condition (iii)

The ball has a lightness L* value of at least 50, preferably at least 52, and more preferably at least 54, but preferably not more than 95, and more preferably not more than 90. This is a necessary condition for preserving the visibility, brightness and high-quality feel of the ball.

Condition (iv)

It is critical that the lightness L* value for the ball≦the lightness L* value for the inside layer. The reason is that the L* value of the (underlying) inside layer must be made larger in order to elicit a sense of transparency and brightness in the ball. The difference between the L* value of the inside layer and the L* value of the ball is preferably at least 10, more preferably at least 20, and even more preferably at least 30.

Condition (v)

It is essential for the inside layer to have a degree of transparency which is up to 10% in terms of total transmittance and up to 10% in terms of parallel transmittance. If the inside layer has a degree of transparency which is greater than this range, the color of the underlying core or the like positioned inside of the inside layer will show through, lowering the L* values of the inside layer and the ball and resulting in an inferior color tone. The inside layer has a total transmittance of preferably at least 0%, but preferably not more than 8%, and more preferably not more than 6%. The parallel transmittance is preferably at least 0%, but preferably not more than 0.4%, and more preferably not more than 0.06%. The above-mentioned "total transmittance" and "parallel transmittance" are calculated in accordance with JIS K7105 (1981).

Condition (vi)

It is essential for the cover to have a degree of transparency which is at least 50% in terms of total transmittance and is at least 1.0% in terms of parallel transmittance. One reason is that, to confer a sense or quality, the cover as a whole must be finished so as to be a little transparent, thereby giving the ball a color tone that shows through the cover. Another reason is to bring out the brightness of the inside layer. The total transmittance of the cover is preferably at least 52%, and more preferably at least 54%, but preferably not more than 95%, and more preferably not more than 90%.

The core used in the invention may be obtained by vulcanizing a rubber composition prepared by blending a known rubber material such as 1,4-cis polybutadiene as the base resin together with a co-crosslinking agent (e.g., unsaturated carboxylic acids and metal salts thereof), an inorganic filler (e.g., zinc oxide and barium sulfate) and an organic peroxide (e.g., dicumyl peroxide and 1,1-bis(t-butylperoxy)cyclohexane). In the present invention, no particular limitation is imposed on the core diameter. Nor is any particular limitation imposed on the color of the core.

The material making up the inside layer used in the present invention is not subject to any particular limitation. For example, the inside layer may be formed primarily of a resin material such as any of various types of thermoplastic resins and thermoplastic elastomers.

The inside layer has a thickness which, while not subject to any particular limitation, is preferably at least 0.8 mm, more preferably at least 1.0 mm, and even more preferably at least 1.2 mm, but preferably not more than 3.0 mm, more preferably not more than 2.5 mm, and even more preferably not more than 2.0 mm. If the inside layer is thinner than this range, the color of the core may show through.

It is desirable to add a white pigment such as titanium oxide to the inside layer, the amount of such addition preferably being at least 1 part by weight per 100 parts by weight of the base resin. At an amount of addition lower than the indicated amount, the color of the core may show through.

Haze is mentioned in JIS K7105 (1981) as a photochemical performance test method for plastic, and is calculated as follows.

$$\text{Haze}(H)=T_d/T_t\times 100(\%)$$

Here, $T_t$ is the total light transmittance and $T_d$ is the diffuse transmittance.

In the practice of the invention, the inside layer has a haze (H) of preferably at least 90, more preferably at least 93, and even more preferably at least 96, but preferably not more than 100. Moreover, it is preferable for the intermediate layer to have a diffuse transmittance ($T_d$) of from 4.0 to 10.

The cover used in the invention has a haze (H) of preferably at least 30 but not more than 95, and has a diffuse transmittance of preferably at least 10 but not more than 90, and more preferably at least 20 but not more than 80.

The cover material used in the invention is formed using primarily a resin material such as a thermoplastic resin or a thermoplastic elastomer. By adding suitable amounts of various pigments or dyes, the desired effects of the invention can be achieved.

Examples of pigments and dyes that may be added to the cover include, but are not limited to, light-harvesting pink dyes, solvent yellow dyes, solvent orange dyes, anthraquinone dyes, phthalocyanine dyes, fluorescent yellow pigments, fluorescent pink pigments and fluorescent orange pigments. Use may be made of known commercial products.

The amount of pigment or dye added to the cover is preferably from 0.001 to 0.4 part by weight per 100 parts by weight of the base resin. By keeping the amount of pigment or dye added within the above range, the resistance to color change of the ball as a whole can be enhanced.

It is advantageous to use a blue dye as the above-described dye included in the cover. The amount of addition in such a case is preferably not more than 0.1 part by weight per 100 parts by weight of the base resin. It is preferable for the cover surface to have a color with an L* value of at least 50, an a* value of from −20 to 20, and a b* value of −20 or below. In particular, the L* value is preferably at least 53, and more preferably at least 55, but preferably not more than 90, more preferably not more than 85, and even more preferably not more than 80. This is because, given that the color of the turf on a golf course is green in the summer and yellow in the winter, bluish balls which are positioned opposite the a* axis and the b* axis from green and yellow are the easiest to find. Moreover, as is generally known, blue has a mood calming effect.

When a dye is included in the cover, it is preferable to use calcium carbonate as the diffuser for the dye. In such a case, the amount of calcium carbonate is set to preferably at least 1.0 part by weight per 100 parts by weight of the base resin. This is because calcium carbonate has a lower refractive index than titanium oxide, and thus increases the overall transparency of the cover. The amount of calcium carbonate included is preferably at least 1.3 parts by weight, and more preferably at least 1.5 parts by weight, but preferably not more than 3 parts by weight, more preferably not more than 2.8 parts by weight, and even more preferably not more than 2.6 parts by weight.

The cover has a thickness which, while not subject to any particular limitation, is preferably at least 0.3 mm, more preferably at least 0.7 mm, and even more preferably at least 1.0 mm, but preferably not more than 2.1 mm, more preferably not more than 1.8 mm, and even more preferably not more than 1.5 mm. If the cover is thicker than the above range, the cover may lose its sense of transparency.

The cover and the inside layer have a combined thickness of preferably from 0.8 to 3.0 mm.

Generally, a large number of dimples are formed on the surface of a golf ball. In the present invention. In the present invention, the number of dimples formed on the ball surface, while not subject to any particular limitation, is preferably at least 250 but not more than 330. The dimples formed on the ball surface have a surface coverage (SR) which, while not subject to any particular limitation, is preferably at least 80%, and more preferably at least 90%, but preferably not more than 98%, and more preferably not more than 95%. By setting the number and surface coverage of the dimples within the above ranges, land areas on the surface of the ball become relatively small, which results in a better sense of transparency and thus a higher sense of quality for the ball.

The surface of the cover may be clear-coated (coated with a clear coating), in which case it is preferable for a two-part curing urethane coating to be used for clear coating. The two-part curing urethane coating is composed of a polyol component having hydroxyl groups and polyisocyanate component having isocyanate groups.

Examples of polyols that may be used include primarily urethanes, polyesters and acrylic resins, although other resins, including epoxy resins, may be used if necessary. Examples of polyisocyanates that may be used include tolylene diisocyanate (TDI), diphenylmethane-4,4'-diisocyanate (MDI), hexamethylene diisocyanate (HDI), isophorone diisocyanate (IPDI), naphthalene diisocyanate (NDI), 1,4-phenylene diisocyanate (PDI), xylylene diisocyanate (XDI) and hydrogenated xylylene diisocyanate (HXDI), either singly or in modified forms as combinations thereof. The polyisocyanate may generally be in the form of an adduct, a biuret or an isocyanurate.

The applied coat of the above coating has a thickness of preferably at least 5 μm, and more preferably at least 10 μm, but preferably not more than 20 μm, and more preferably not more than 16 μm. An applied coat that is too thin may be a factor in reducing the durability of the coating. On the other hand, if the applied coat is too thick, the rebound of the ball may decrease, shortening the carry, in addition to which separation of the core and the cover tends to arise. As a result, the durability of the ball to repeated impact may decrease.

Any known method used in the art may be employed as the coating method. For example, the ball may be perched on the tips of needles on a needle bed, and the entire ball coated with any of various types of coatings.

In the coating, various solvents and additives are suitably added to the above-described resin serving as the base, in addition to which a pearlescent pigment may be included. When a pearlescent pigment is used, it is preferable to include from 0.05 to 0.5 part by weight of a fluorescent whitener and from 0.1 to 0.6 part by weight of the pearlescent pigment per 100 parts by weight of the base resin. Moreover, it is preferable for the pearlescent pigment to be used in such a way that the weight ratio of the fluorescent whitener to the pearlescent pigment (fluorescent whitener/pearlescent pigment) is from 0.08 to 0.5. If the amount of pearlescent pigment included is too large, the ease of coating application may drastically decline, the ball may have a decreased rebound, and there may be a tendency for the applied coat to peel. Also, it is important to adjust the ratio of fluorescent whitener to pearlescent pigment in order to bring out the luminosity and brightness of the ball. If the amounts of the fluorescent whitener and the pearlescent pigment added are inappropriate, the ball may not have a suitable luminosity, as a result of which the desired effects of the invention may not be achieved.

Pearlescent pigments are broadly divided into metal oxide-coated micas, basic lead carbonate, bismuth oxychloride and natural pearl essence. Of these, the selection of a metal oxide-coated mica is preferred because such pigments are nontoxic and have the best chemical stability. Titanium dioxide or iron oxide is typically used as the metal oxide; by varying the coverage (thickness of the coating layer), various colors and interference effects can be achieved. The larger the particle size of these pigments, the greater the degree of luster that can be achieved. However, at a larger pigment particle size, the luster tends to subside. Hence, it is desirable to select a pigment having a suitable particle size.

Because a golf ball to which has been applied a coating that contains such a pearlescent pigment is able to reflect light at various angles, the sense of quality is increased. Moreover, because sunlight is fully reflected, the golf ball can be made easier to find.

The golf ball of the invention, which can be manufactured so as to conform with the Rules of Golf for competitive play, may be produced to a ball diameter which is not less than 42.67 mm and to a weight which is not more than 45.93 g.

With regard to the method of manufacturing the inventive golf ball, a multi-piece golf ball composed of three or more layers may be manufactured by vulcanizing a rubber composition composed primarily of polybutadiene or the like under known vulcanization conditions to form a molded and vulcanized rubber piece (core), then successively forming an inside layer and a cover over the core by a known method such as injection molding. Generally, to create a large number of dimples on the surface of the ball, the dimples are formed by a large number of projections on the inside walls of the mold cavity at the same time that the material for forming the cover (outermost layer) is injection molded.

As described above, the colored golf ball of the invention is a fluorescent ball which nonetheless retains a sense of transparency and has a high-quality feel, in addition to which it has a good weather resistance and is capable of preventing a change in color. Moreover, the colored golf ball of the invention has a reassuring and psychologically calming effect on the golfer during play, and it has a suitable look and feel.

EXAMPLES

The following Examples of the invention and Comparative Examples are provided by way of illustration and not by way of limitation.

Examples 1 to 8, Comparative Examples 1 to 7

A rubber composition having a common formulation in the examples of the invention and the comparative examples was prepared, then masticated with a kneader or a roll mill, following which cores were fabricated under specific vulcanizing conditions. The inside layer-forming resin mixtures shown in Table 1 were then injection-molded over the core in a mold. The resulting sphere composed of the core encased by the inside layer (referred to below as the "intermediate layer") was then set in another mold and the cover material shown in Table 2 was injection-molded over the sphere, thereby giving colored golf balls according to the examples of the invention and the comparative examples. The lo numbers shown in the resin mixture formulations in Tables 1 and 2 indicate parts by weight.

| Core Formulation | |
|---|---|
| Polybutadiene rubber | 100 parts by weight |
| Zinc acrylate | 29 parts by weight |
| Peroxide | 1.2 parts by weight |
| Antioxidant | 0.1 part by weight |
| Zinc oxide | 26.7 parts by weight |
| Zinc salt of pentacholorothiophenol | 0.2 part by weight |
| Red pigment | 0.08 part by weight |

The rubber was vulcanized for 15 minutes at 155° C. The above-mentioned peroxide was a mixture of 1,1-di(t-butylperoxy)cyclohexane and silica, which is produced by NOF Corporation under the trade name Perhexa C-40. The above-mentioned antioxidant is Nocrac NS-6, which is available from Ouchi Shinko Chemical Industry Co., Ltd.

TABLE 1

| Intermediate layer material | | a | b |
|---|---|---|---|
| Ionomer | SURLYN 6320 (trade name) | 60 | 60 |
| | NUCREL 035C (trade name) | 40 | 40 |
| Fatty acid | Magnesium stearate | 69 | 69 |
| Cation | Magnesium oxide | 0.8 | 0.8 |
| Colorant | Titanium oxide | 4.1 | |
| | Magnesium stearate | 1.0 | |
| | Yellow pigment | | 0.02 |

SURLYN 6320

A magnesium-neutralized ethylene-methacrylic acid-acrylic acid ester copolymer available from E.I. DuPont de Nemours & Co., Ltd.

NUCREL 035C

An ethylene-methacrylic acid-acrylic acid ester copolymer available from DuPont-Mitsui Polychemicals Co., Ltd.

Magnesium Stearate

Available from Dainichi Kagaku under the trade name M-5GN.

Magnesium Oxide

Magnesium oxide produced by Kyowa Chemical Industry.

Titanium Oxide

Available from Ishihara Sangyo Kaisha under the trade name Tipaque R550.

TABLE 2

| Cover material | | c | d | e | f | g | h | i |
|---|---|---|---|---|---|---|---|---|
| Ionomer | HIMILAN 1557 (trade name) | 75 | 75 | 75 | 75 | | | |
| | HIMILAN 1855 (trade name) | 25 | 25 | 25 | 25 | | | |
| | HIMILAN 1605 (trade name) | | | | | 50 | 50 | 50 |
| | HIMILAN 1706 (trade name) | | | | | 50 | 50 | 50 |
| Fatty acid | Magnesium stearate | 69 | 69 | 69 | 69 | | | |
| Cation | Magnesium oxide | 0.8 | 0.8 | 0.8 | 0.8 | | | |
| Colorant | Titanium oxide | 0.03 | | 0.02 | | 0.078 | 0.1 | |
| | Calcium carbonate | | 1.5 | 1.5 | 1.3 | | | |
| | Light-harvesting dye | | | 0.01 | | | | |
| | Solvent yellow (dye) | | 0.09 | | 0.035 | | | |
| | Solvent orange (dye) | | | | 0.004 | | | |
| | Anthraquinone (dye) | | | 0.002 | | | | |
| | Phthalocyanine (dye) | 0.045 | | | | | | |
| | Fluorescent pigment (yellow) | | | | | 1.56 | | |
| | Fluorescent pigment (pink) | | | | | | 0.2 | |
| | Fluorescent pigment (orange) | | | | | | | 0.98 |

HIMILAN 1557

A zinc-neutralized ethylene-methacrylic acid copolymer available from DuPont-Mitsui Polychemicals Co., Ltd.

HIMILAN 1855

A zinc-neutralized ethylene-methacrylic acid-acrylic acid ester copolymer available from DuPont-Mitsui Polychemicals Co., Ltd.

HIMILAN 1605

A sodium-neutralized ethylene-methacrylic acid copolymer available from DuPont-Mitsui Polychemicals Co., Ltd.

HIMILAN 1706

A zinc-neutralized ethylene-methacrylic acid copolymer available from DuPont-Mitsui Polychemicals Co., Ltd.

Magnesium Stearate

Available from NOF Corporation under the trade name Magnesium Stearate G.

Magnesium Oxide

Magnesium oxide produced by Kyowa Chemical Industry.

Titanium Oxide

Available from Ishihara Sangyo Kaisha under the trade name Tipaque R550.

TABLE 3

| | | Example | | | | | | | |
|---|---|---|---|---|---|---|---|---|---|
| | | 1 | 2 | 3 | 4 | 5 | 6 | 7 | 8 |
| Target color | | blue | blue | yellow | yellow | pink | pink | orange | orange |
| Coating | | clear | pearl | clear | pearl | clear | pearl | clear | pearl |
| Core color | | red | red | red | red | red | red | red | red |
| Core diameter (mm) | | 37.3 | 37.3 | 37.3 | 37.3 | 37.3 | 37.3 | 37.3 | 37.3 |
| Core color | L* | 71.3 | 71.3 | 71.3 | 71.3 | 71.3 | 71.3 | 71.3 | 71.3 |
| | a* | 38.0 | 38.0 | 38.0 | 38.0 | 38.0 | 38.0 | 38.0 | 38.0 |
| | b* | 7.8 | 7.8 | 7.8 | 7.8 | 7.8 | 7.8 | 7.8 | 7.8 |
| Intermediate layer formulation | | a | a | a | a | a | a | a | a |
| Intermediate layer gauge (mm) | | 1.45 | 1.45 | 1.45 | 1.45 | 1.45 | 1.45 | 1.45 | 1.45 |
| Total transmittance | | 5.51 | 5.51 | 5.51 | 5.51 | 5.51 | 5.51 | 5.51 | 5.51 |
| Haze | | 99.4 | 99.4 | 99.4 | 99.4 | 99.4 | 99.4 | 99.4 | 99.4 |
| Diffuse transmittance | | 5.48 | 5.48 | 5.48 | 5.48 | 5.48 | 5.48 | 5.48 | 5.48 |
| Parallel transmittance | | 0.03 | 0.03 | 0.03 | 0.03 | 0.03 | 0.03 | 0.03 | 0.03 |
| Intermediate layer color | L* | 95.6 | 95.6 | 95.6 | 95.6 | 95.6 | 95.6 | 95.6 | 95.6 |
| | a* | −1.2 | −1.2 | −1.2 | −1.2 | −1.2 | −1.2 | −1.2 | −1.2 |
| | b* | −3.6 | −3.6 | −3.6 | −3.6 | −3.6 | −3.6 | −3.6 | −3.6 |
| $(a^{*2} + b^{*2})^{1/2}$ | | 3.8 | 3.8 | 3.8 | 3.8 | 3.8 | 3.8 | 3.8 | 3.8 |
| Cover formulation | | c | c | d | d | e | e | f | f |
| Cover gauge (mm) | | 1.25 | 1.25 | 1.25 | 1.25 | 1.25 | 1.25 | 1.25 | 1.25 |
| Total transmittance | | 57.4 | 57.4 | 85.8 | 85.8 | 54.4 | 54.4 | 71.2 | 71.2 |
| Haze | | 36.2 | 36.2 | 92.0 | 92.0 | 92.8 | 92.8 | 92.5 | 92.5 |
| Diffuse transmittance | | 20.8 | 20.8 | 78.9 | 78.9 | 48.6 | 48.6 | 65.8 | 65.8 |
| Parallel transmittance | | 36.6 | 36.6 | 6.9 | 6.9 | 3.8 | 3.8 | 5.4 | 5.4 |
| Ball color | L* | 59.7 | 64.9 | 93.5 | 93.4 | 65.1 | 67.7 | 81.7 | 82.8 |
| | a* | −20.8 | −12.0 | −25.7 | −23.8 | 56.6 | 47.7 | 23.2 | 20.6 |
| | b* | −47.1 | −36.8 | 103.7 | 90.9 | 2.2 | 7.0 | 90.2 | 74.5 |
| Color difference ΔE* between intermediate layer and ball | | 59.7 | 46.5 | 110.1 | 97.2 | 65.6 | 57.3 | 97.9 | 82.1 |
| Color change resistance | | good | good | good | good | good | good | good | good |
| High-quality feel | | good | excellent | good | excellent | good | excellent | good | excellent |
| Subdued color | | excellent | excellent | good | good | good | good | good | good |
| Visibility on turf | | good | excellent | good | excellent | good | excellent | good | excellent |

TABLE 4

| | | Comparative Example | | | | | | |
|---|---|---|---|---|---|---|---|---|
| | | 1 | 2 | 3 | 4 | 5 | 6 | 7 |
| Target color | | blue | yellow | pink | orange | yellow | pink | orange |
| Coating | | clear | clear | clear | clear | clear | clear | clear |
| Core color | | red | red | red | red | red | red | red |
| Core diameter (mm) | | 37.3 | 37.3 | 37.3 | 37.3 | 37.3 | 37.3 | 37.3 |
| Core color | L* | 71.3 | 71.3 | 71.3 | 71.3 | 71.3 | 71.3 | 71.3 |
| | a* | 38.0 | 38.0 | 38.0 | 38.0 | 38.0 | 38.0 | 38.0 |
| | b* | 7.8 | 7.8 | 7.8 | 7.8 | 7.8 | 7.8 | 7.8 |
| Intermediate layer formulation | | b | b | b | b | a | a | a |
| Intermediate layer gauge (mm) | | 1.45 | 1.45 | 1.45 | 1.45 | 1.45 | 1.45 | 1.45 |
| Total transmittance | | 82.1 | 82.1 | 82.1 | 82.1 | 5.51 | 5.51 | 5.51 |
| Haze | | 8.8 | 8.8 | 8.8 | 8.8 | 99.4 | 99.4 | 99.4 |
| Diffuse transmittance | | 7.2 | 7.2 | 7.2 | 7.2 | 5.48 | 5.48 | 5.48 |
| Parallel transmittance | | 75.2 | 75.2 | 75.2 | 75.2 | 0.03 | 0.03 | 0.03 |
| Intermediate layer color | L* | 65.1 | 65.1 | 54.8 | 65.1 | 95.6 | 95.6 | 95.6 |
| | a* | 31.9 | 31.9 | −33.8 | 31.9 | −1.2 | −1.2 | −1.2 |
| | b* | 38.4 | 38.4 | 2.3 | 38.4 | −3.6 | −3.6 | −3.6 |
| $(a^{*2} + b^{*2})^{1/2}$ | | 50.0 | 50.0 | 33.9 | 50.0 | 3.8 | 3.8 | 3.8 |
| Cover formulation | | c | d | e | f | g | h | i |
| Cover gauge (mm) | | 1.25 | 1.25 | 1.25 | 1.25 | 1.25 | 1.25 | 1.25 |
| Total transmittance | | 57.4 | 85.8 | 54.4 | 71.2 | 48.5 | 30.6 | 44.8 |
| Haze | | 36.2 | 92.0 | 92.8 | 92.5 | 99.5 | 99.1 | 99.3 |
| Diffuse transmittance | | 20.8 | 78.9 | 48.6 | 65.8 | 48.3 | 30.3 | 44.5 |
| Parallel transmittance | | 36.6 | 6.9 | 3.8 | 5.4 | 0.2 | 0.3 | 0.3 |
| Ball color | L* | 40.3 | 66.9 | 46.6 | 65.4 | 94.6 | 66.9 | 70.5 |
| | a* | −13.9 | 15.3 | 16.8 | 34.2 | −26.9 | 64.5 | 59.4 |
| | b* | −17.2 | 67.1 | −4.7 | 63.7 | 92.6 | 63.4 | −23.8 |

TABLE 4-continued

| | Comparative Example | | | | | | |
|---|---|---|---|---|---|---|---|
| | 1 | 2 | 3 | 4 | 5 | 6 | 7 |
| Color difference ΔE* between intermediate layer and ball | 76.2 | 33.2 | 51.8 | 25.4 | 99.6 | 98.1 | 68.6 |
| Color change resistance | good | good | good | good | fair | fair | fair |
| High-quality feel | NG | NG | NG | fair | fair | fair | fair |
| Subdued color | NG | fair | NG | fair | fair | fair | fair |
| Visibility on turf | NG | fair | fair | NG | good | good | good |

The appearance-related properties of the intermediate layer, cover and golf ball obtained in each of the examples of the invention and the comparative examples were rated according to the following criteria. The results are shown in Tables 3 and 4.

Total Transmittance and Parallel Transmittance

Measurement was carried out using a light transmittance measuring instrument (Turbidimeter NDH500OW, manufactured by Nippon Denshoku Industries Co., Ltd.), and the total transmittance and parallel transmittance were determined based on JIS K7105. Higher values for total transmittance and parallel transmittance indicate that light passes through more easily; i.e., that the degree of transparency is higher. Conversely, lower values indicate that light passes through with greater difficulty; i.e., that the degree of transparency is smaller.

Lower values for haze and diffuse transmittance indicate lower levels of haze and light diffusion, signifying better transparency.

Color Difference ΔE*

Measurement was carried out using a color difference meter (model SC-P, manufactured by Suga Test Instruments Co., Ltd.), and the color difference ΔE* was determined based on the L*a*b* color system in JIS Z8729. A larger value indicates a larger color difference, and a smaller value indicates a smaller color difference.

Color Change Resistance

The ball was irradiated for 24 hours with a mercury vapor lamp. The degree of color change upon exposure to ultraviolet light was observed, and rated as follows.

| | |
|---|---|
| Good: | Substantially no change in color |
| Fair: | Slight change in color |
| NG: | Large change in color |

High-Quality Feel

Sensory evaluations based on the following criteria were carried out by ten skilled golfers.

| | |
|---|---|
| Excellent: | Eight or more of the 10 golfers thought the ball had a high-quality feel |
| Good: | Five to seven of the 10 golfers thought the ball had a high-quality feel |
| Fair: | Three or four of the 10 golfers thought the ball had a high-quality feel |
| NG: | Two or fewer of the 10 golfers thought the ball had a high-quality feel |

Subdued Color

Sensory evaluations based on the following criteria were carried out by ten skilled golfers.

| | |
|---|---|
| Excellent: | Eight or more of the 10 golfers thought the ball had a subdued color |
| Good: | Five to seven of the 10 golfers thought the ball had a subdued color |
| Fair: | Three or four of the 10 golfers thought the ball had a subdued color |
| NG: | Two or fewer of the 10 golfers thought the ball had a subdued color |

Visibility on Turf

Sensory evaluations based on the following criteria were carried out by ten skilled golfers.

| | |
|---|---|
| Excellent: | Eight or more of the 10 golfers thought the ball was easy to see on turf |
| Good: | Five to seven of the 10 golfers thought the ball was easy to see on turf |
| Fair: | Three or four of the 10 golfers thought the ball was easy to see on turf |
| NG: | Two or fewer of the 10 golfers thought the ball was easy to see on turf |

From the results in Tables 3 and 4, the respective comparative examples were inferior in the following ways to the examples according to the present invention.

In Comparative Example 1, the transparency of the intermediate layer was too high, allowing the color of the core to show through and thus resulting in poor ball coloration.

In Comparative Example 2, the transparency of the intermediate layer was too high, allowing the color of the core to show through and thus resulting in poor ball coloration.

In Comparative Example 3, the transparency of the intermediate layer was too high, allowing the color of the core to show through and thus resulting in poor ball coloration.

In Comparative Example 4, the transparency of the intermediate layer was too high, allowing the color of the core to show through and thus resulting in poor ball coloration. Moreover, owing to the small color difference between the intermediate layer and the ball, the ball lacked a sense of transparency and coloration was poor.

In Comparative Example 5, because the cover had a low transparency, the ball lacked a high-quality feel and a subdued color.

In Comparative Example 6, because the cover had a low transparency, the ball lacked a high-quality feel and a subdued color.

In Comparative Example 7, because the cover had a low transparency, the ball lacked a high-quality feel and a subdued color.

Various types of dimple patterns were placed on the ball construction in Example 1, and the sense of cover transparency was examined. These dimple patterns Nos. 1 to 7 are shown in Table 5 below and in accompanying FIGS. 2 to 8.

Each dimple pattern was formed on the cover surface at the same time that the cover resin material was injection molded.

TABLE 5

Figure 2:
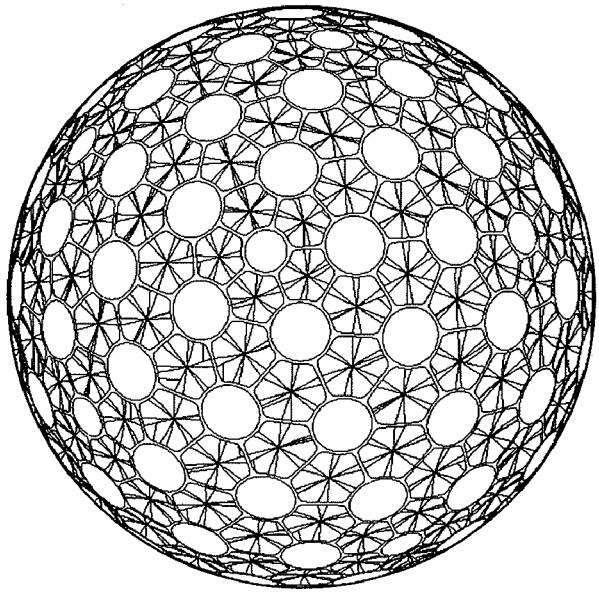
FIG. 2 is a top view of a golf ball showing dimple pattern No. 1 used in an example of the invention.
Figure 3:
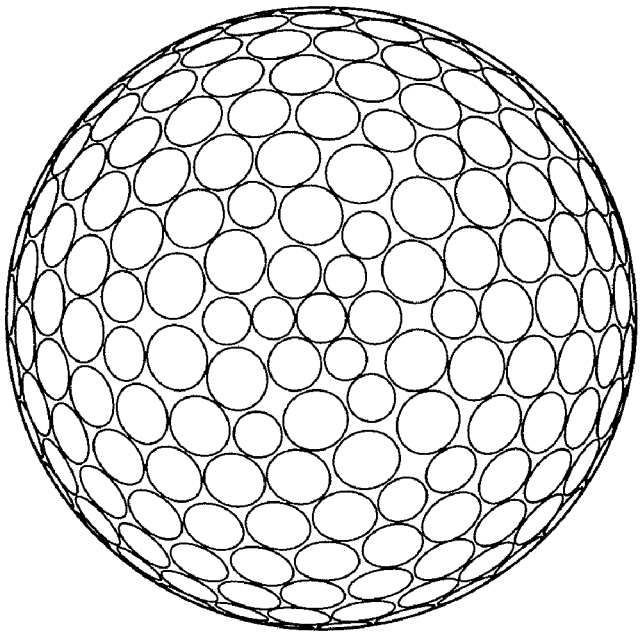
FIG. 3 is a top view of a golf ball showing dimple pattern No. 2 used in an example of the invention.
Figure 4:
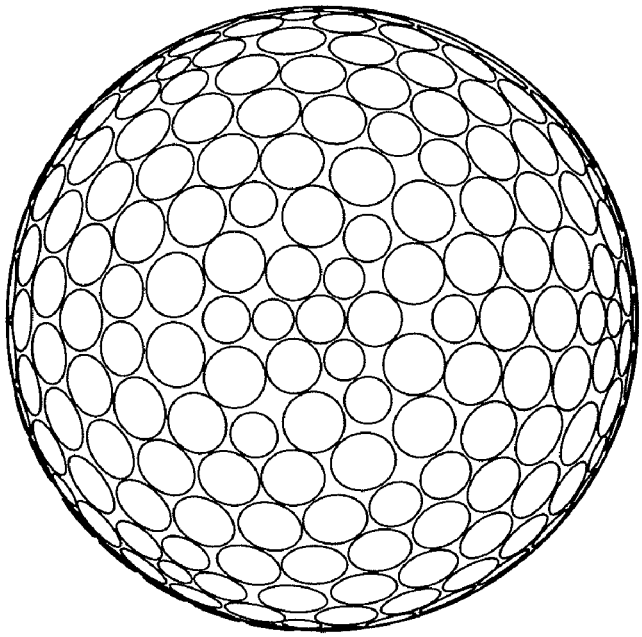
FIG. 4 is a top view of a golf ball showing dimple pattern No. 3 used in an example of the invention.
Figure 5:
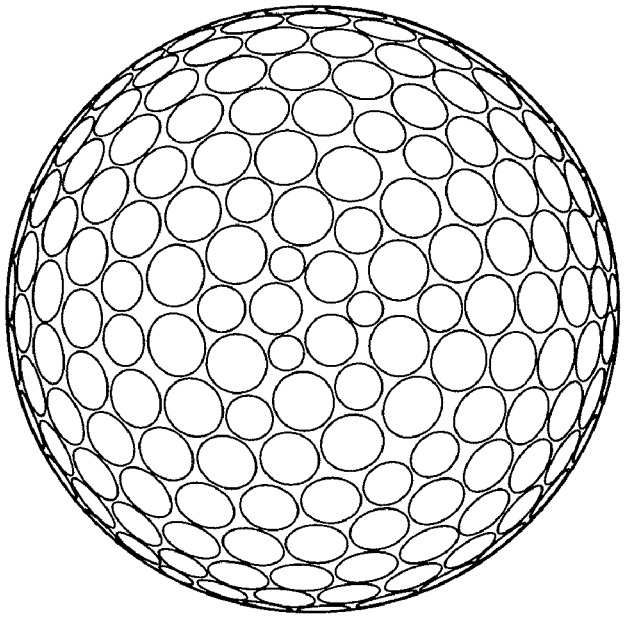
FIG. 5 is a top view of a golf ball showing dimple pattern No. 4 used in an example of the invention.
Figure 6:
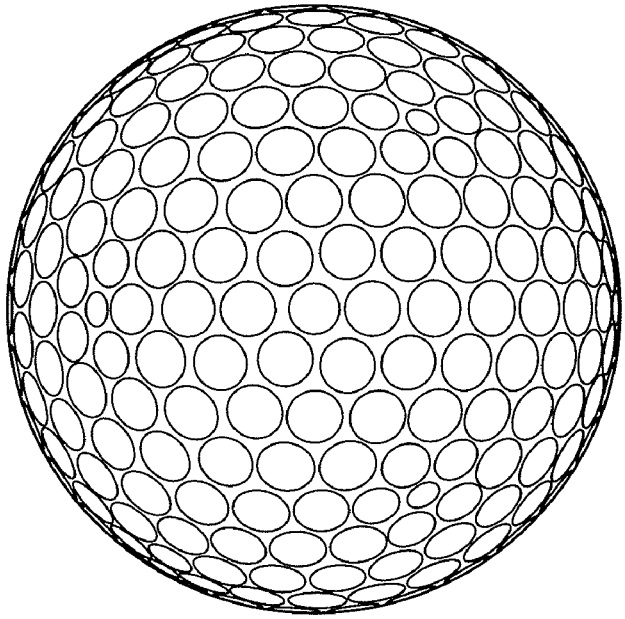
FIG. 6 is a top view of a golf ball showing dimple pattern No. 5 used in an example of the invention.
Figure 7:
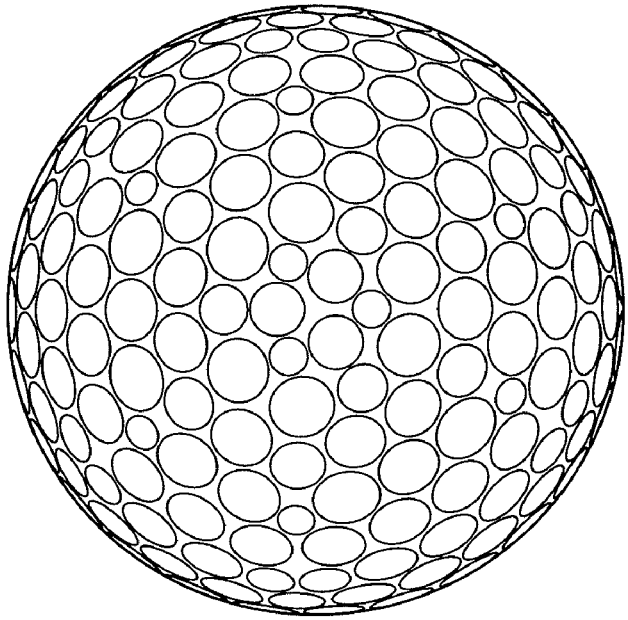
FIG. 7 is a top view of a golf ball showing dimple pattern No. 6 used in an example of the invention.
Figure 8:
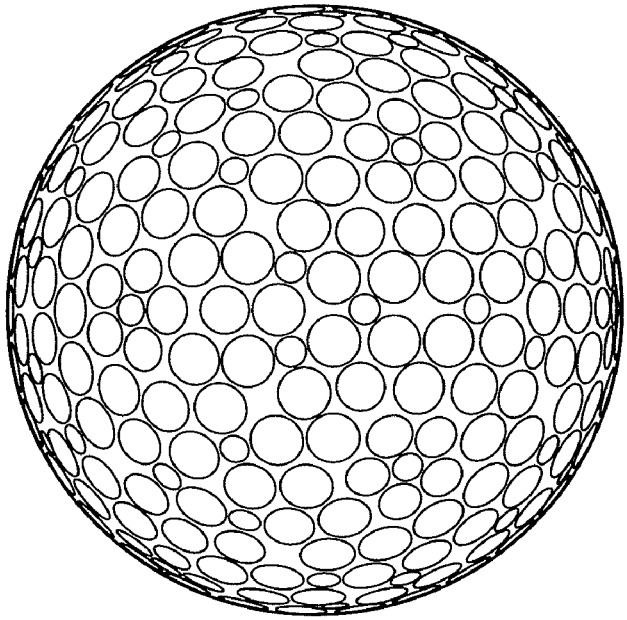
FIG. 8 is a top view of a golf ball showing dimple pattern No. 7 used in an example of the invention.

| | Dimple pattern | | | | | | |
|---|---|---|---|---|---|---|---|
| | No. 1 | No. 2 | No. 3 | No. 4 | No. 5 | No. 6 | No. 7 |
| Arrangement in pattern of dimples | FIG. 2 | FIG. 3 | FIG. 4 | FIG. 5 | FIG. 6 | FIG. 7 | FIG. 8 |
| Total number of dimples | 326 | 326 | 344 | 330 | 368 | 306 | 432 |
| Ratio of dimple areas (%) (ratio of surface other than lands (SR)) | 90 | 81.3 | 82.1 | 80.5 | 78.2 | 77.8 | 75.2 |

Ratio of Dimple Areas (SR)

This ratio is the sum of the individual dimple surface areas, defined for each dimple as the surface area of the flat plane enclosed by the dimple edge, as a percentage of the spherical surface area of the ball were the ball to have no dimples thereon.

The sense of cover transparency was evaluated. When sensory evaluations were carried out by ten skilled golfers, eight or more of the golfers rated covers bearing the dimple pattern in FIG. 2 as having a sense of transparency; from five to seven of the golfers rated covers bearing the dimple patterns in FIGS. 3, 4 and 5 as having a sense of transparency; three or four of the golfers rated covers bearing the dimple pattern in FIG. 6 as having a sense of transparency; and two or fewer golfers rated covers bearing the dimple patterns in FIGS. 7 and 8 as having a sense of transparency.

The invention claimed is:

1. A colored golf ball comprising a core, a cover having a plurality of dimples formed on an outside surface thereof, and an inside layer in contact with the cover, which ball satisfies the following conditions:

(i) a color difference $\Delta E^*$ between the inside layer and the ball of at least 30;

(ii) the inside layer has a lightness $L^*$ value, expressed in the $L^*a^*b^*$ color system based on JIS Z8729, of at least 82 and a chroma C, defined as $(a^{*2}+b^{*2})^{1/2}$, of at most 10;

(iii) the ball has a lightness $L^*$ value of at least 50;

(iv) the lightness $L^*$ value of the ball≦the lightness $L^*$ value of the inside layer;

(v) the inside layer has a transparency which is up to 10% in terms of total transmittance and up to 1.0% in terms of parallel transmittance; and (vi) the cover has a transparency which is at least 50% in terms of total transmittance and at least 1.0% in terms of parallel transmittance.

2. The colored golf ball of claim 1, wherein the surface of the ball is coated with a coating composed of 100 parts by weight of a base resin, from 0.05 to 0.5 part by weight of a fluorescent whitener and from 0.1 to 0.6 part by weight of a pearlescent pigment, which coating has a fluorescent whitener/pearlescent pigment weight ratio of from 0.08 to 5.0.

3. The colored golf ball of claim 1, wherein the inside layer and the cover have a combined thickness of from 0.8 to 3.0 mm.

4. The colored golf ball of claim 1, wherein the inside layer contains at least 1 part by weight of a white pigment per 100 parts by weight of base resin.

5. The colored golf ball of claim 1, wherein the cover has a thickness of from 0.3 to 2.1 mm.

6. The colored golf ball of claim 1, wherein the cover contains of from 0.001 to 0.4 part by weight of a pigment or dye per 100 parts by weight of base resin.

7. The colored golf ball of claim 6, wherein the dye in the cover is a blue dye which is included in an amount of up to 0.1 part by weight per 100 parts by weight of base resin, and the cover has a surface color with an $L^*$ value of at least 50, an $a^*$ value of from −20 to 20, and a $b^*$ value of −20 or below.

8. The colored golf ball of claim 6, wherein the cover contains at least 1.0 part by weight of calcium carbonate as a diffuser for the dye per 100 parts by weight of base resin.

9. The colored golf ball of claim 1, wherein the number of dimples is at most 330 and the sum of the individual dimple surface areas, defined for each dimple as the surface area of a flat plane enclosed by an edge of the dimple, is at least 80% of the spherical surface area of the ball were the ball to have no dimples thereon.

* * * * *